US010253659B2

(12) United States Patent
Janowiak

(10) Patent No.: US 10,253,659 B2
(45) Date of Patent: Apr. 9, 2019

(54) BALL PLUNGER FOR USE IN A HYDRAULIC LASH ADJUSTER AND METHOD OF MAKING SAME

(71) Applicant: Eaton Corporation, Cleveland, OH (US)

(72) Inventor: Gary Janowiak, Saginaw, MI (US)

(73) Assignee: Eaton Corporation, Cleveland, OH (US)

( * ) Notice: Subject to any disclaimer, the term of this patent is extended or adjusted under 35 U.S.C. 154(b) by 361 days.

(21) Appl. No.: 15/180,751

(22) Filed: Jun. 13, 2016

(65) Prior Publication Data

US 2016/0290178 A1 Oct. 6, 2016

Related U.S. Application Data

(60) Continuation of application No. 13/484,701, filed on May 31, 2012, now Pat. No. 9,388,714, which is a
(Continued)

(51) Int. Cl.
*F01L 1/14* (2006.01)
*F01L 1/24* (2006.01)
(Continued)

(52) U.S. Cl.
CPC ..... *F01L 1/24* (2013.01); *B21C 23/14* (2013.01); *B21C 23/20* (2013.01); *F01L 1/2405* (2013.01);
(Continued)

(58) Field of Classification Search
CPC ..... F01L 1/2405; F01L 1/24; F01L 2103/00; F01L 1/14; Y10T 29/49304;
(Continued)

(56) References Cited

U.S. PATENT DOCUMENTS 1,348,007 A * 7/1920 Huntoon ..... B21C 23/14 72/256
2,681,644 A 6/1954 Purchas, Jr. et al.
(Continued)

FOREIGN PATENT DOCUMENTS

CN 201593451 9/2010
DE 3935027 A 4/1991
(Continued)

OTHER PUBLICATIONS

British Search Report for British Application No. GB1207977.8 dated Aug. 6, 2012.
(Continued)

*Primary Examiner* — Sarang Afzali
*Assistant Examiner* — Darrell C Ford
(74) *Attorney, Agent, or Firm* — RMCK Law Group PLC

(57) ABSTRACT

A method of cold-forming a ball plunger blank includes providing a slug having a generally cylindrical surface extending between a first end and a second end, transferring the slug to a first forming station, at the first forming station forming an indentation in at least one of the first and second ends, and rotating the slug and transferring the slug to a second forming station. The method further includes extruding a first bore through the first end while simultaneously forming a hemispherical surface at the second end, backward extruding a second bore at the first end, and forming a counterbore in the second end.

19 Claims, 5 Drawing Sheets

Related U.S. Application Data division of application No. 12/235,919, filed on Sep. 23, 2008.

(51) Int. Cl.
*B21C 23/14* (2006.01)
*B21C 23/20* (2006.01)

(52) U.S. Cl.
CPC ..... *F01L 1/14* (2013.01); *F01L 2103/00* (2013.01); *Y10T 29/493* (2015.01); *Y10T 29/49298* (2015.01); *Y10T 29/49304* (2015.01); *Y10T 29/49311* (2015.01); *Y10T 29/49313* (2015.01); *Y10T 29/49995* (2015.01)

(58) Field of Classification Search
CPC ..... Y10T 29/49313; Y10T 29/493; Y10T 29/49311; Y10T 29/49298; Y10T 29/49995; B21C 23/20; B21C 23/14
USPC ..... 29/557, 888.43, 888.4, 888.44, 888.451, 29/888.452; 72/354.6, 355.2, 355.6, 358, 72/359, 370.1; 123/90.43, 90.45, 90.46, 123/90.55
See application file for complete search history.

(56) References Cited

U.S. PATENT DOCUMENTS

| | | | | |
|---|---|---|---|---|
| 3,054,177 | A | 9/1962 | Duhamel | |
| 3,540,255 | A * | 11/1970 | Hanna | B21C 23/20 470/14 |
| 3,910,091 | A | 10/1975 | Samanta | |
| 3,943,741 | A * | 3/1976 | Sunderland | B21C 45/00 72/57 |
| 3,962,899 | A * | 6/1976 | Hubbell | B21J 5/02 72/334 |
| 4,004,558 | A | 1/1977 | Scheibe | |
| 4,083,334 | A | 4/1978 | Roncon | |
| 4,098,240 | A | 7/1978 | Abell, Jr. | |
| 4,206,628 | A * | 6/1980 | Miller | B21J 9/14 72/355.6 |
| 4,227,495 | A | 10/1980 | Krieg | |
| 4,249,408 | A | 2/1981 | Lovell | |
| 4,367,701 | A | 1/1983 | Buente | |
| 4,463,714 | A | 8/1984 | Nakamura | |
| 4,498,326 | A * | 2/1985 | Brandt | H01R 43/16 470/137 |
| 4,807,576 | A | 2/1989 | Sonoda et al. | |
| 4,903,651 | A | 2/1990 | Matsuura et al. | |
| 4,904,230 | A | 2/1990 | Kawashima et al. | |
| 4,945,749 | A * | 8/1990 | Walker | B21C 23/03 72/344 |
| 5,285,873 | A * | 2/1994 | Arbesman | B21C 23/20 188/250 G |
| 5,509,385 | A | 4/1996 | Lavieri | |
| 5,515,819 | A | 5/1996 | Groh et al. | |
| 5,551,143 | A | 9/1996 | Saval et al. | |
| 5,706,771 | A | 1/1998 | Van Heyningen et al. | |
| 5,706,773 | A * | 1/1998 | Dura | F01L 1/2405 123/90.51 |
| 5,855,191 | A | 1/1999 | Blowers et al. | |
| 5,901,676 | A | 5/1999 | Edelmayer | |
| 5,918,367 | A | 7/1999 | Todo et al. | |
| 6,325,034 | B1 | 12/2001 | Edelmayer | |
| 6,385,847 | B1 | 5/2002 | Larson et al. | |
| 6,386,421 | B1 | 5/2002 | Anderson et al. | |
| 6,571,452 | B1 * | 6/2003 | Wang | B21K 1/56 29/557 |
| 6,735,997 | B2 | 5/2004 | Rosenberger et al. | |
| 6,871,622 | B2 | 3/2005 | Mandal et al. | |
| 6,941,915 | B1 * | 9/2005 | Masello | F01L 1/2405 123/90.45 |
| 6,964,251 | B2 | 11/2005 | Mandal et al. | |
| 7,013,857 | B2 | 3/2006 | Williams et al. | |
| 7,025,025 | B2 | 4/2006 | Mandal et al. | |
| 7,028,654 | B2 | 4/2006 | Mandal et al. | |
| 7,032,553 | B2 | 4/2006 | Williams et al. | |
| 7,047,925 | B2 * | 5/2006 | Hendriksma | F01L 1/2405 123/90.39 |
| 7,069,891 | B2 | 7/2006 | Mandal et al. | |
| 7,128,034 | B2 | 10/2006 | Mandal et al. | |
| 7,191,745 | B2 | 3/2007 | Mandal et al. | |
| 7,207,302 | B2 | 4/2007 | Williams et al. | |
| 7,273,026 | B2 | 9/2007 | Mandal et al. | |
| 7,281,329 | B2 | 10/2007 | Mandal et al. | |
| 7,284,520 | B2 | 10/2007 | Mandal et al. | |
| 7,293,540 | B2 | 11/2007 | Mandal et al. | |
| 7,322,324 | B2 | 1/2008 | Hara et al. | |
| 7,350,491 | B2 | 4/2008 | Stretch et al. | |
| 2005/0183686 | A1 | 8/2005 | Fujii et al. | |
| 2006/0013521 | A1 | 1/2006 | Krintzline et al. | |
| 2006/0016405 | A1 | 1/2006 | Harris et al. | |
| 2006/0130795 | A1 | 6/2006 | Williams et al. | |
| 2007/0157898 | A1 | 7/2007 | Mandal et al. | |
| 2007/0193544 | A1 | 8/2007 | Mandal et al. | |
| 2007/0214639 | A1 | 9/2007 | Mandal et al. | |
| 2007/0234989 | A1 | 10/2007 | Mandal et al. | |
| 2008/0118301 | A1 | 5/2008 | Nishio et al. | |
| 2008/0277034 | A1 | 11/2008 | Roth | |
| 2009/0044775 | A1 | 2/2009 | Tallio et al. | |
| 2010/0071649 | A1 | 3/2010 | Janowiak | |
| 2011/0277715 | A1 * | 11/2011 | Janowiak | F01L 1/2405 123/90.55 |
| 2018/0283224 | A1 * | 10/2018 | Ahmed | F01L 1/2405 |
| 2018/0291771 | A1 * | 10/2018 | Roberts | B23C 3/30 |

FOREIGN PATENT DOCUMENTS

| | | | |
|---|---|---|---|
| DE | 19932346 | A | 1/2001 |
| DE | 102004032240 | A | 2/2006 |
| EP | 1619359 | A | 1/2006 |
| GB | 2112896 | A | 7/1983 |
| GB | 2185549 | A | 7/1987 |
| JP | S5888412 | A | 5/1983 |
| JP | S5929712 | A | 2/1984 |
| JP | S59209440 | A | 11/1984 |
| JP | H0126007 | B2 | 5/1989 |
| JP | H06330711 | | 11/1994 |
| JP | 2004211585 | A | 7/2004 |

OTHER PUBLICATIONS

Chinese Office Action for Chinese Patent Application No. 200910176624.8 dated Feb. 1, 2013 and English translation thereof.
Chinese Office Action for Chinese Patent Application No. 200910176624.8 dated Sep. 29, 2013 and English translation thereof.
Chinese Search Report for Chinese Application No. 2014102112073 dated Sep. 23, 2009, 2 pages.
European Search Report for European Application No. 11165519.7 dated Aug. 22, 2011.
International Search Report and Written Opinion for International Patent App. No. PCT/IB2009/007017 dated Jan. 4, 2010.
Japanese Office Action for Japanese Patent Application No. 2011-528450 dated Aug. 14, 2013 and English translation thereof.

* cited by examiner

CUTOFF

1st

2nd

3rd

4th

5th

BALL PLUNGER FOR USE IN A HYDRAULIC LASH ADJUSTER AND METHOD OF MAKING SAME

CROSS REFERENCE TO RELATED APPLICATIONS

This application is a continuation of U.S. patent application Ser. No. 13/484,701 filed on May 31, 2012, now issued as U.S. Pat. No. 9,388,714, which is a divisional of U.S. patent application Ser. No. 12/235,919, filed on Sep. 23, 2008. The disclosures of the above applications are incorporated by reference herein in their entirety.

FIELD

The present disclosure is directed to a ball plunger for use in a hydraulic lash adjuster and a method of manufacturing the ball plunger.

BACKGROUND

Hydraulic lash adjusters (also sometimes referred to as "lifters") for internal combustion engines have been in use for many years to eliminate clearance (or "lash") between engine valve train components under varying operating conditions, in order to maintain efficiency and to reduce noise and wear in the valve train. Hydraulic lash adjuster operate on the principle of transmitting the energy of the valve actuating cam through hydraulic fluid trapped in a pressure chamber under a plunger. In a Type II valve train, the plunger is known as a "ball plunger" because it has a ball-shaped portion at one end and a seat surface at its other end. During each operation of the cam, as the length of the valve actuating components varies as a result of temperature changes and wear, small quantities of hydraulic fluid are permitted to enter the pressure chamber, or escape therefrom, thus effecting an adjustment in the position of the ball plunger, and consequently adjusting the effective total length of the valve train.

As is known in the art, ball plungers have been initially made in cold-forming machines and then machined to achieve a desired final shape. However, machining processes are time consuming and add to the cost of the finished ball plunger. There are continual efforts to improve upon the processes to manufacture ball plungers, particularly to reduce the machining time and costs associated therewith.

SUMMARY

In one aspect, a method of cold-forming a ball plunger blank is provided. The method includes providing a slug having a generally cylindrical surface extending between a first end and a second end, transferring the slug to a first forming station, at the first forming station forming an indentation in at least one of the first and second ends, and rotating the slug and transferring the slug to a second forming station. The method further includes extruding a first bore through the first end while simultaneously forming a hemispherical surface at the second end, backward extruding a second bore at the first end, and forming a counterbore in the second end.

In another aspect, a method of cold-forming a ball plunger blank using a cold-forming machine having a cutoff station and five forming stations each with a die section and a punch section is provided. The method includes at the cutoff station, shearing wire to a desired length to form a slug having a generally cylindrical surface extending between a first end and a second end, transferring the slug to the first forming station such that the first end faces the die section and the second end faces the punch section, and rotating the slug and transferring the slug to the second forming station such that the first end faces the punch section and the second end faces the die section. The method further includes at the second forming station, extruding a first bore through the first end and forming a hemispherical surface at the second end, at the third forming station, backward extruding a second bore at the first end, at the fourth forming station, forming a counterbore in the second end, and at the fifth forming station, further forming the hemispherical surface to near final dimensions.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1A:
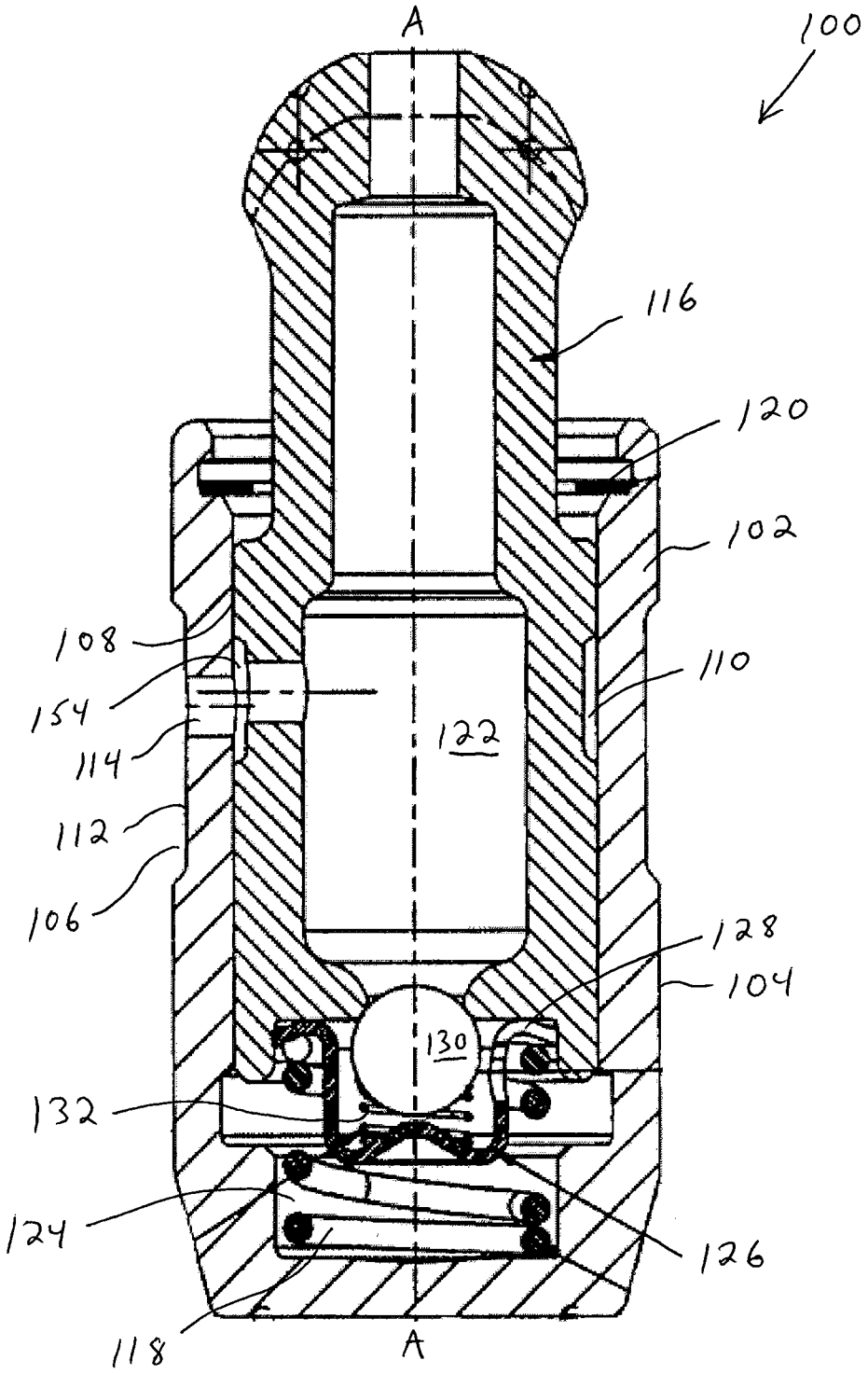
FIG. 1A illustrates a cross-sectional view of an exemplary hydraulic lash adjuster 100.

Certain terminology will be used in the foregoing description for convenience in reference only and will not be limiting. The terms "upward," "downward," "upper," and "lower" will be understood to have their normal meanings and will refer to those directions as the drawing figures are normally viewed. All foregoing terms mentioned above include the normal derivative and equivalents thereof.

The present application is directed to a ball plunger for use in a hydraulic lash adjuster. The ball plunger is of a one-piece construction that is cold-formed to near net shape, requiring a reduced amount of machining to complete the finished part as compared to prior art ball plungers.

FIG. 1A illustrates a cross-sectional view of an exemplary hydraulic lash adjuster 100. The hydraulic lash adjuster 100, which is of the Type II valve train variety, is shown by way of example only and it will be appreciated that the ball plunger employed therein can be used in any configuration of a hydraulic lash adjuster and is not limited to the configuration of the hydraulic lash adjuster 100 illustrated in FIG. 1A. The general structure and operation of the hydraulic lash adjuster 100 shown in FIG. 1A is known to those skilled in the art, and will therefore be described in summary fashion.

As shown in FIG. 1A, the hydraulic lash adjuster 100 includes a body 102 that is configured to be disposed within a mating bore (not shown) in an engine cylinder head (not shown). The body 102 includes a longitudinal axis A, a first generally cylindrical exterior surface 104 having an outwardly facing groove 106, and an interior surface 108 that defines a blind bore 110. The groove 106 is at least partially defined by a second generally cylindrical exterior surface 112 that has an outer diameter that is less than the outer diameter of the first cylindrical exterior surface 104. Extending radially between the first cylindrical exterior surface 104 and the second cylindrical exterior surface 112 is a fluid port 114 that provides fluid communication between the groove 106 and the blind bore 110.

The hydraulic lash adjuster 100 also includes a ball plunger 116 disposed in the blind bore 110. The ball plunger 116, which will be discussed in more detail below, is configured for reciprocal movement relative to the body 102 along the longitudinal axis A. A plunger spring 118 is disposed within the blind bore 104 underneath the ball plunger 116 and is configured to bias the ball plunger 116 in an upward direction relative to the body 102. The plunger spring 118 acts at all times to elevate the ball plunger 116 to maintain its engagement with the hemispherical concave surface (not shown) of a rocker arm (not shown). To limit outward movement of the ball plunger 116 relative to the body 102 and retain the ball plunger 116 within to the body 102, a retaining member 120, such as a retaining ring or washer, is provided adjacent the upper portion of the body 102.

With continued reference to FIG. 1A, the ball plunger 116 itself defines a low pressure fluid chamber 122, while the body 102 and the lower portion of the ball plunger 116 cooperate with each other to define a high pressure fluid chamber 124 within the blind bore 104 of the body 102. To control fluid flow between the low fluid pressure chamber 122 and the high pressure fluid chamber 124, the hydraulic lash adjuster 100 includes a check valve assembly 126 positioned between the plunger spring 118 and the lower portion of the ball plunger 116. The check valve assembly 126 functions to either permit fluid communication, or to block fluid communication, between the low pressure fluid chamber 122 and the high pressure fluid chamber 124, in response to the pressure differential between the two fluid chambers 122, 124.

As shown in FIG. 1A, the check valve assembly 126 includes a retainer 128 that is in engagement with a lower portion of the ball plunger 116, a check ball 130, and a check ball spring 132 that is disposed between the retainer 128 and the check ball 130. The check ball spring 132 is configured to bias the check ball 130 in an upwards direction towards the ball plunger 116, and is therefore commonly referred to by those skilled in the art as a "normally biased closed" check valve assembly.

Figure 1B:
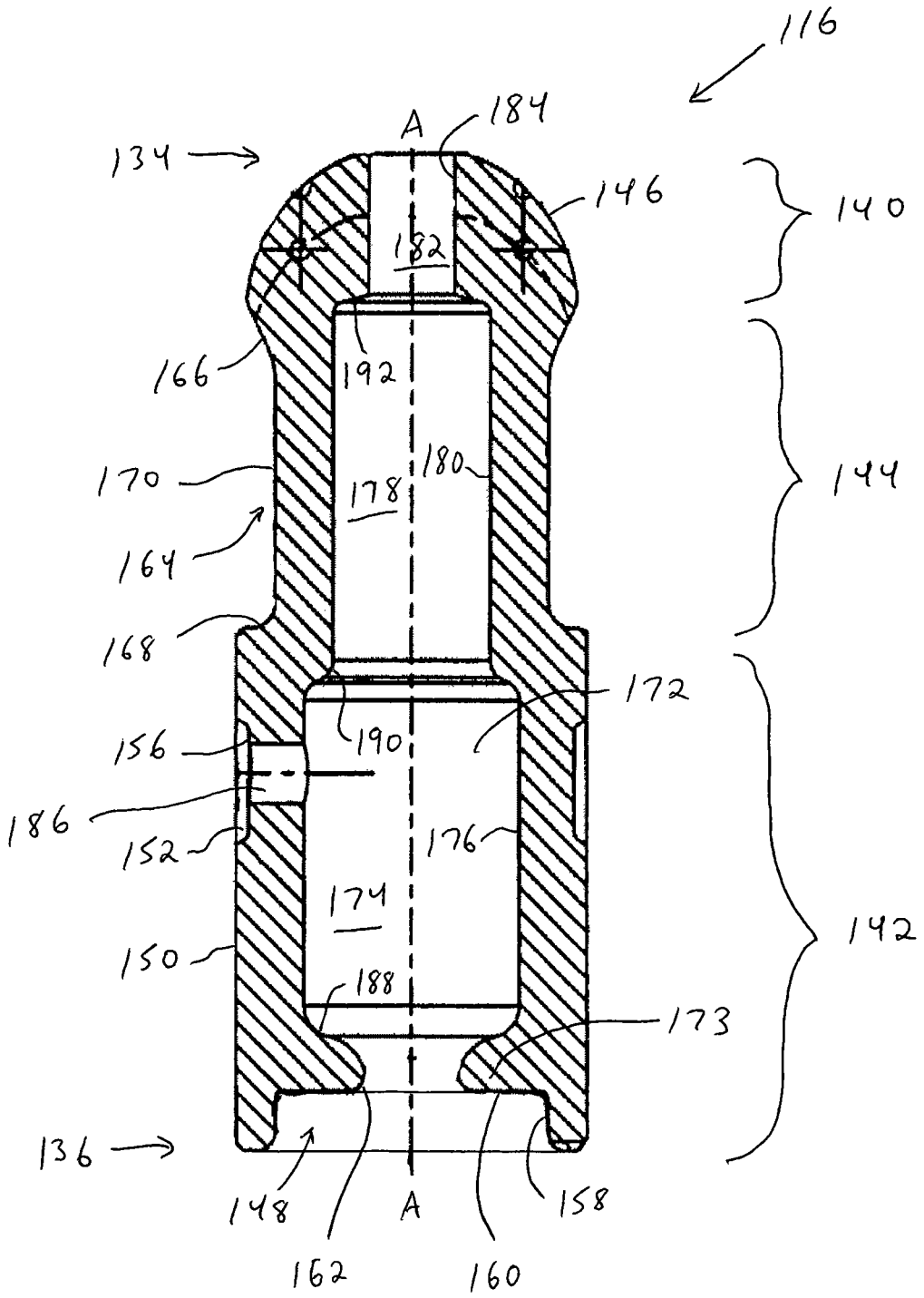
FIG. 1B illustrates a detailed cross-sectional view of one embodiment of a ball plunger 116 for use in the exemplary hydraulic lash adjuster 100.

Illustrated in FIG. 1B is a detailed cross-sectional view of the ball plunger 116 employed in the exemplary hydraulic lash adjuster 100 illustrated in FIG. 1A. It will be appreciated that the ball plunger 116 illustrated in FIGS. 1A and 1B is shown by way of example only and is not limited to the configuration shown in these drawings.

With reference to FIG. 1B, the ball plunger 116 is a generally tubular member having a first end 134 that extends to a second end 136 along a longitudinal axis A, a ball portion 140 adjacent to the first end 134, a body portion 142 adjacent to the second end 136, and a stem portion 144 disposed between the ball portion 140 and the body portion 142. The ball portion 140 of the ball plunger 116 includes a generally ball-shaped or hemispherical outer surface 146, which is configured to engage and pivot about the generally hemispherical concave surface (not shown) of a rocker arm (not shown).

The body portion 142 of the ball plunger 116 includes a counterbore 148 configured to receive the check valve assembly 126, a first generally cylindrical exterior surface 150, and a radially outward facing groove 152 formed in the cylindrical exterior surface 150. The groove 152 cooperates with the interior surface 108 of the body 102 to form a fluid collector channel 154 (see FIG. 1A) and is at least partially defined by a second generally cylindrical exterior surface 156 that has an outer diameter that is less than the outer diameter of the first cylindrical exterior surface 150.

With continued reference to FIG. 1B, the counterbore 148 is defined by a generally cylindrical interior surface 158, a flat annular surface 160 that is generally perpendicular to the axis A and extends from the cylindrical interior surface 158, and a rounded annular surface 162 that extends from the flat annular surface 160. The flat annular surface 160 is sized to receive the retainer 128 of the check valve assembly 126 and will sometimes be referred to herein as the "retainer receiving surface 160." The rounded annular surface 162 is sized to receive the check ball 130 of the check valve assembly 126, such that when the check ball 130 engages the rounded annular surface 162, a fluid tight seal is created between the check ball 130 and the rounded annular surface 162 (see FIG. 1A). Hence, the rounded annular surface 162 may also be referred to herein as the "ball seat 162" or the "ball seat surface 162." Although the ball seat surface 162 in the illustrated embodiment of the ball plunger 116 is a rounded annular surface, it will be appreciated that the ball seat surface 162 can be an annular frusto-conical surface, so long as an appropriate fluid tight seal is created between the check ball 130 and the ball seat surface 162.

The stem portion 144 of the ball plunger 116 is defined by a groove 164 that separates the ball portion 140 from the body portion 142 of the ball plunger 116. The groove 164 is at least partially defined by a frusto-conical surface 166 that extends from the hemispherical exterior surface 146 towards the body portion 142, a transition surface 168 that extends from the first cylindrical exterior surface 150 towards the ball portion 140, and a generally cylindrical exterior surface 170 disposed between the frusto-conical surface 166 and the transition surface 168. In the illustrated example, the transition surface 168 includes a frusto-conical surface and a curved surface that is convex with respect to the longitudinal axis A. However, it will be appreciated that the transition surface 168 can include an annular surface that is generally perpendicular to the axis A, a frusto-conical surface, a curved surface that is concave or convex with respect to the longitudinal axis A, or any combination thereof.

With continued reference to FIG. 1B, disposed within the ball plunger 116 between the ball seat surface 162 and the hemispherical exterior surface 146 is an axially extending passage 172. Provided between the passage 172 and the counterbore 148 is a shoulder 173 that includes, among other surfaces, the retainer receiving surface 160 and the ball seat surface 162.

Generally, the passage 172 (which also corresponds to the low pressure fluid chamber 122 as shown in FIG. 1A) includes a first axially extending bore 174 defined by a first generally cylindrical interior surface 176 having a first diameter, a second axially extending bore 178 defined by a second generally cylindrical interior surface 180 having a second diameter that is less than the first diameter of the first cylindrical interior surface 176, and a third axially extending bore 182 defined by a third generally cylindrical interior surface 184 having a third diameter that is less than the second diameter of the second cylindrical interior surface 180. Extending radially between the first cylindrical interior surface 176 and the second cylindrical exterior surface 156 is a plunger fluid port 186 that provides fluid communication between the groove 152 and the first bore 174.

The passage 172 is also defined by three transition surfaces—a first transition surface 188 that transitions the ball seat surface 162 to the first cylindrical interior surface 176, a second transition surface 190 that transitions the first cylindrical interior surface 176 to the second cylindrical interior surface 180, and a third transition surface 192 that transitions the second cylindrical interior surface 180 to the third cylindrical interior surface 184. It will be appreciated that each of these transition surfaces can include an annular surface that is generally perpendicular to the axis A, a frusto-conical surface, a curved surface that is concave or convex with respect to the longitudinal axis A, or any combination thereof.

Figure 2:
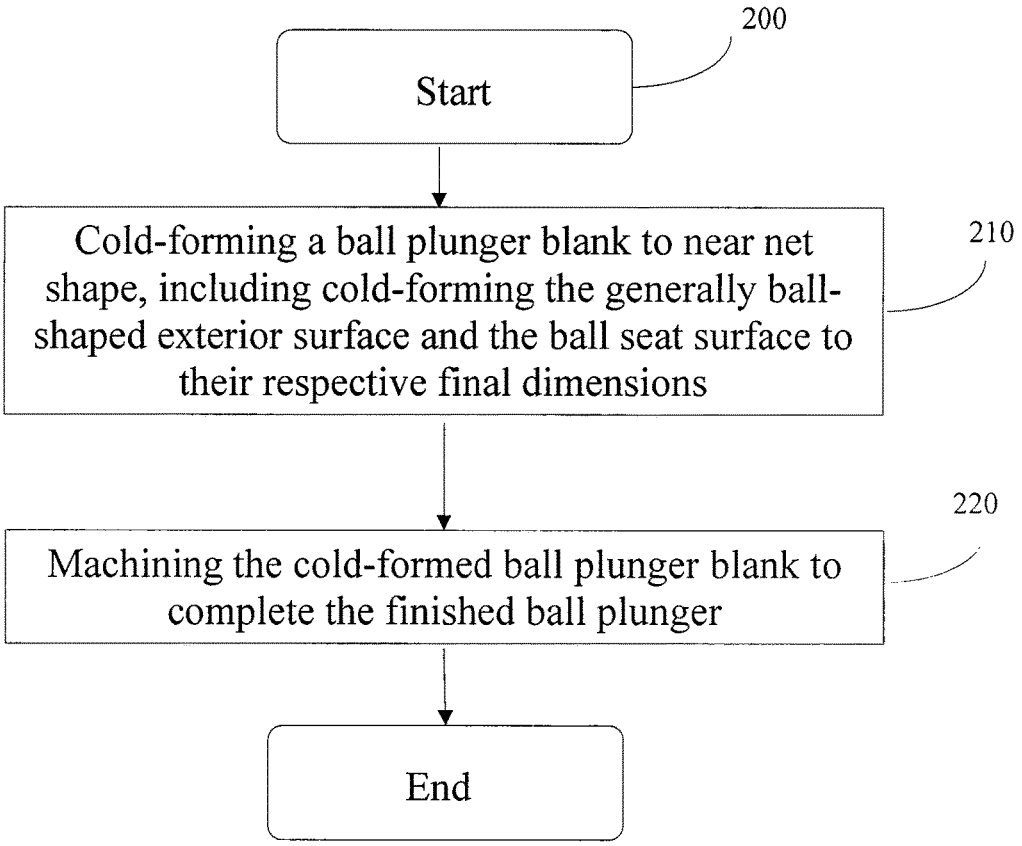
FIG. 2 illustrates an example method 200 of producing the ball plunger 116 described above and illustrated in FIGS. 1A and 1B.

Illustrated in FIG. 2 is an example method 200 of producing the ball plunger 116 described above and illustrated in FIGS. 1A and 1B. As shown in FIG. 2, the method 200 includes two general steps—i) cold-forming a ball plunger blank to near net shape, including cold-forming the generally ball-shaped outer surface 146 and the ball seat surface 162 to their respective final dimensions (step 210) and ii) machining the cold-formed ball plunger blank to complete the finished ball plunger 116 (step 220). As used herein, the term "cold-forming" and its derivatives, is intended to encompass what is known in the art as "cold forging," "cold heading," and "deep drawing." As used herein, the term "machining" means the use of a chucking machine, drilling machine, turning machine, grinding machine, or broaching machine to remove material.

Figures 3, 4A, 4B, 4C, 4D, 4E, 4F:
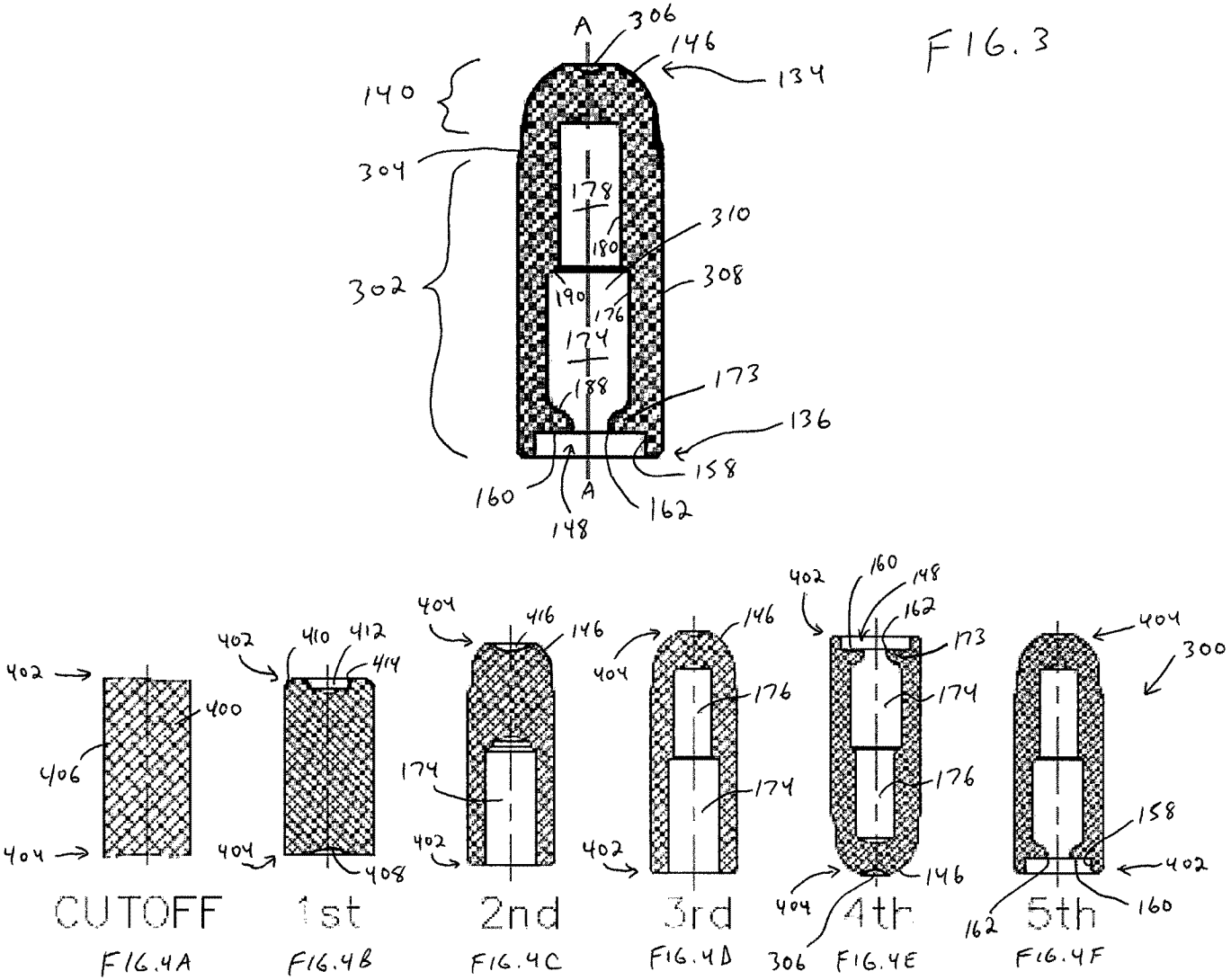
FIG. 3 illustrates a cross-sectional view of one embodiment of a cold-formed ball plunger blank 300 following the cold-forming step (step 210) described in FIG. 2.
FIGS. 4A-4F illustrates an exemplary cold-forming, five station slug progression sequence that can be used to form the cold-formed ball plunger blank 300.

Illustrated in FIG. 3 is a cross-sectional view of one embodiment of a cold-formed ball plunger blank 300 that is the result of the cold-forming step (step 210) described above. As shown in FIG. 3, the cold-formed ball plunger blank 300 is near net shape as compared to the finished ball plunger 116. For consistency purposes, structural features that are common between the cold-formed ball plunger blank 300 and the finished ball plunger 116 will be indicated with the same reference numerals, while different structural features will be indicated with new reference numerals.

As shown in FIG. 3, the cold-formed ball plunger blank 300 includes a generally cup-shaped member having a first end 134 extending toward a second end 136 along a longitudinal axis A, a ball portion 140 adjacent the first end 134, an extended body portion 302 adjacent the second end 136, and a transition surface 304 separating the ball portion 140 from the extended body portion 302. The ball portion 140 includes a generally ball-shaped or hemispherical outer surface 146 and a dimple or indentation 306 extending therefrom. In the illustrated embodiment, the transition surface 304 includes a frusto-conical surface. However, it will be appreciated that the transition surface 304 can include an annular surface that is generally perpendicular to the axis A, a frusto-conical surface, a curved surface that is concave or convex with respect to the longitudinal axis A, or any combination thereof.

The extended body portion 302 of the cold-formed ball plunger blank 300 includes a counterbore 148 and a generally cylindrical exterior surface 308. The counterbore 148 is defined by a generally cylindrical interior surface 158, a flat annular surface 160 that is generally perpendicular to the axis A and extends from the cylindrical interior surface 158 (also referred to as the "retainer receiving surface 160"), and a rounded annular surface 162 (also referred to as the "ball seat 162" or the "ball seat surface 162") that extends from the retainer receiving surface 160.

With continued reference to FIG. 3, disposed within the cold-formed ball plunger blank 300 is an axially extending bore or cavity 310 extending from the ball seat surface 162 towards the ball portion 140. Provided between the cavity 310 and the counterbore 148 is a shoulder 173 that includes, among other surfaces, the retainer receiving surface 160 and the ball seat surface 162.

Generally, the cavity 310 includes a first bore 174 defined by a first generally cylindrical interior surface 176 having a first diameter and a second bore 178 defined by a second generally cylindrical interior surface 180 having a second diameter that is less than the first diameter of the first cylindrical interior surface 176.

The cavity 310 is also defined by two transition surfaces—a first transition surface 188 that transitions the ball seat surface 162 to the first cylindrical interior surface 176 and a second transition surface 190 that transitions the first cylindrical interior surface 176 to the second cylindrical interior surface 180. It will be appreciated that each of these transition surfaces can include an annular surface that is generally perpendicular to the axis A, a frusto-conical surface, a curved surface that is concave or convex with respect to the longitudinal axis A, or any combination thereof.

The cold-formed ball plunger blank 300 can be formed in a variety of cold-forming machines. Suitable examples of cold-forming machines that can be used to form the cold-formed ball plunger blank 300 include Waterbury and National Machinery cold-forming machines. Generally, cold-forming machines include a cut-off station for cutting metal wire to a desired length to provide an initial workpiece (also known as a "slug") and multiple progressive forming stations that include multiple spaced-apart die sections and a reciprocating gate having multiple punch sections, each of which cooperates with a respective die section to form a die cavity. A conventional transfer mechanism moves the slug in successive steps from the cut-off station to each of the forming stations in a synchronized fashion and is also capable of rotating the slug 180 degrees as it is being transferred from one station to another. As cold-forming machines are well known in the art, no further description is necessary.

In one embodiment, the cold-formed ball plunger blank 300 is formed in a five station, cold-forming machine (not shown). It will, however, be appreciated that the cold-formed ball plunger blank 300 can be produced in a different number of forming stations.

Illustrated in FIGS. 4A-4E is an exemplary cold-forming, five station slug progression sequence that can be used to form the cold-formed ball plunger blank 300. Each figure represents the state of the slug at an end-of-stroke tool position. It will be appreciated that this slug progression sequence is merely one example of a cold-forming slug progression sequence and that other slug progression sequences are possible.

The exemplary slug progression sequence begins with shearing wire to a desired length at the cut-off station to provide an initial slug 400, which will be described with reference to a first end 402, a second end 404, and a cylindrical surface 406 that extends therebetween as shown in FIG. 4A. At this stage, the ends of the slug 400 have irregularities or unevenness inherent in the shearing process. The slug 400 is then transferred to the first forming station where its first end 402 faces the die section and its second end 404 faces the punch section.

At the first forming station, the slug 400 is squared and a slight indentation 408 is formed in the second end 404 at the punch section of the cold-forming machine as shown in FIG. 4B. At the die section of the cold-forming machine, a chamfer 410 is simultaneously formed between the first end 402 and the cylindrical surface 406 of the slug 400. Additionally, at the die section, a deeper indentation 412 is formed in the first end 402 of the slug 400 along with a chamfer 414 formed between the indentation 412 and the first end 402. The indentation 412 serves to properly center and guide the punch from the second forming station, which will be described in further detail below. The slug 400 is then rotated 180 degrees and transferred to the second forming station where its first end 402 faces the punch section and its second end 404 faces the die section.

At the second forming station, the first bore 174 is extruded through the first end 402 of the slug 400 to near final dimensions at the punch section of the cold-forming machine as shown in FIG. 4C. Simultaneously, at the die section of the cold-forming machine, the generally hemispherical surface 146 is beginning to be formed at the second end 404 of the slug 400. Additionally, a slight indentation 416 is formed in the second end 404 of the slug 400. The indentation 416 serves to properly center and guide the punch from the fourth forming station, which will be described in further detail below. The slug 400 is then transferred to the third forming station where its second end 404 faces the punch section and its first end 402 faces the die section.

At the third forming station, the second bore 176, having a diameter less than the first bore 174, is backward extruded at the first end 402 of the slug 400 to near final dimensions at the punch section of the cold-forming machine as shown in FIG. 4D. Simultaneously, at the die section of the cold-forming machine, the hemispherical surface 146 is formed at the second end 404 of the slug 400 to near final dimensions. The slug 400 is then rotated 180 degrees and transferred to the fourth forming station where its second end 404 faces the punch section and its first end 402 faces the die section.

At the fourth forming station, the hemispherical surface 146 is formed to near final dimensions and the dimple 306 is formed in the center-point of the hemispherical surface 146 by the punch section of the cold-forming machine as shown in FIG. 4E. Simultaneously, at the die section of the cold-forming machine, a counterbore 148, having a diameter greater than the first bore 174, is formed in the second end 404 of the slug 400. Due to this diametrical difference, the die that forms the counterbore 148 upsets the wall defining the first bore 174 and thereby forms the shoulder 173 that defines the retainer receiving surface 160 and the ball seat surface 162 to near final dimensions. The slug 400 is then rotated 180 degrees and transferred to the fifth forming station where its first end 402 faces the punch section and its second end 404 faces the die section.

At the fifth forming station, as shown in FIG. 4F, the slug 400 is formed to its final dimensions, including overall length and the hemispherical surface 146 being formed to its final dimensions. Also, the cylindrical interior surface 158, the retainer receiving surface 160, and the ball seat surface 162 are coined to their respective final dimensions by the punch section of the cold-forming machine. At the conclusion of the fifth forming station, the cold-formed ball plunger blank 300 is completed and includes all of the structural features shown in FIG. 3.

As discussed above, the cold-formed ball plunger blank 300 includes all of the structural features of the finished ball plunger 116 described above and illustrated in FIGS. 1A and 1B, with the exception of several structural features. To complete the method 200 of producing the finished ball plunger 116 described above and illustrated in FIGS. 1A and 1B, the cold-formed ball plunger blank 300 is machined to form the remaining structural features as discussed above and shown in FIG. 2.

Figure 5:
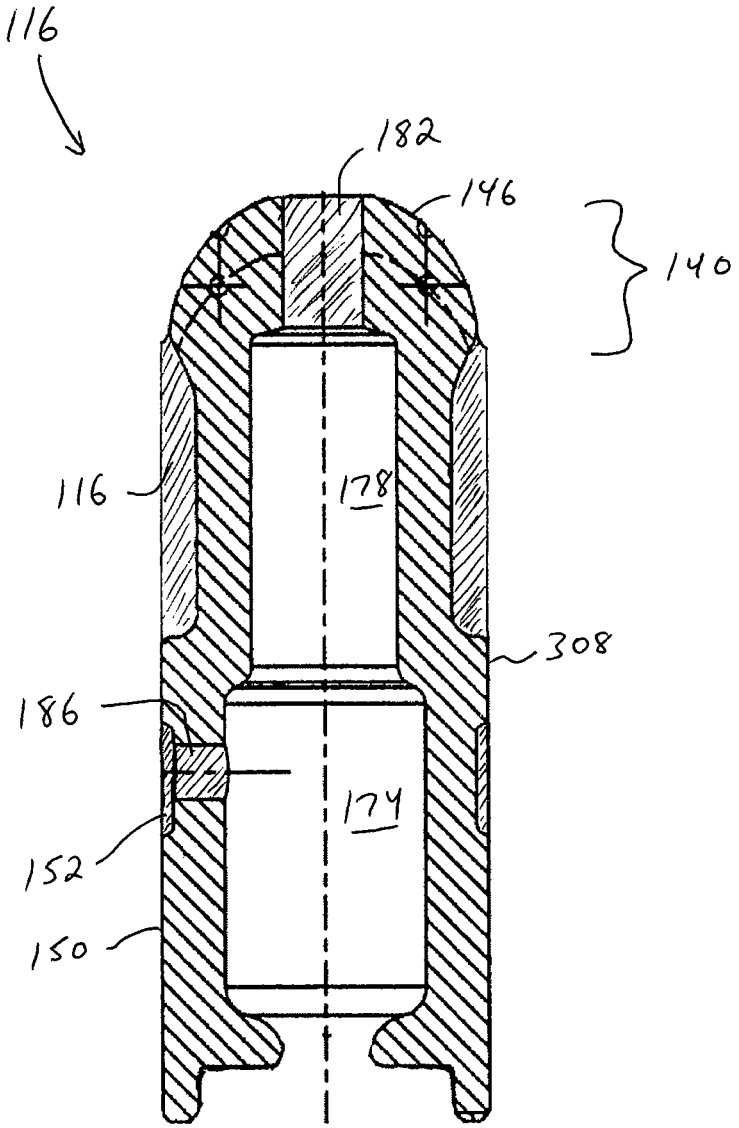
FIG. 5 illustrates a cross-sectional view of the finished ball plunger 116 following the machining step (step 220) described in FIG. 2.

The machining step (step 220) will be discussed with reference to FIG. 5 where the shaded areas of the finished ball plunger 116 represent the material removed from the cold-formed ball plunger blank 300 as a result of the machining step. As shown in FIG. 5, the groove 164 is machined into the extended body portion 302 and a portion of the hemispherical surface 146 and the groove 152 is machined into the first cylindrical exterior surface 150. Additionally, the third bore 182 is drilled into the ball portion 140, such that it communicates with the second bore 178, and the plunger fluid port 186 is drilled into the body portion 142 such that it communicates with the first bore 174. It will be appreciated that these machining operations can be performed one at a time, in combination with one or more other machining operations, or all together in any sequence.

Unlike prior art ball plungers, the ball plunger 116 described above is cold formed to near net shape (including the cold formation to final dimensions of the ball portion 140 and the ball seat surface 162), thereby reducing the machine time to complete a finished ball plunger and thus reducing manufacturing cost of the finished ball plunger. Additionally, when compared to plunger designs that require the use of a seat insert and seal, these parts along with the associated assembly time and costs are eliminated.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto."

Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present application illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A method of cold-forming a ball plunger blank comprising the steps of:

providing a slug having a generally cylindrical surface extending between a first end and a second end;

transferring the slug to a first forming station;

at the first forming station, forming an indentation in at least one of the first and second ends;

rotating the slug and transferring the slug to a second forming station;

extruding a first bore through the first end while simultaneously forming a hemispherical surface at the second end;

backward extruding a second bore at the first end; and forming a counterbore in the second end.

2. The method of claim 1, wherein the step of forming an indentation includes forming a slight indentation in the second end.

3. The method of claim 1, wherein the step of forming an indentation includes forming an indentation in the first end.

4. The method of claim 1, further comprising, at the first forming station, forming at least one chamfer at the first end.

5. The method of claim 4, wherein the step of forming at least one chamfer includes forming a chamfer between the first end and the cylindrical surface simultaneously with the step of forming the at least one indentation.

6. The method of claim 4, wherein the step of forming at least one chamfer includes forming a chamfer between the at least one indentation and the first end.

7. The method of claim 1, wherein the step of rotating the slug comprises rotating the slug approximately 180°, wherein the first and second ends switch positions.

8. The method of claim 1, further comprising rotating the slug and transferring the slug to the third forming station.

9. The method of claim 8, further comprising:

at a third forming station, further forming the hemispherical surface while simultaneously backward extruding the second bore.

10. The method of claim 9, further comprising rotating the slug and transferring the slug to a fourth forming station.

11. The method of claim 1, further comprising further forming the hemispherical surface while simultaneously extruding the second bore.

12. The method of claim 10, further comprising at the fourth forming station, further forming the hemispherical surface to near final dimensions while simultaneously forming the counterbore.

13. The method of claim 1, further comprising further forming the hemispherical surface to near final dimensions while simultaneously forming the counterbore.

14. The method of claim 13, further comprising rotating the slug and transferring the slug to a fifth forming station.

15. The method of claim 14, further comprising at the fifth forming station, forming the hemispherical surface to final dimensions.

16. The method of claim 15, further comprising at the fifth forming station, forming a ball seat surface and a retainer receiving surface at the first end.

17. A method of cold-forming a ball plunger blank using a cold-forming machine having a cutoff station and five forming stations each with a die section and a punch section, the method comprising:

at the cutoff station, shearing wire to a desired length to form a slug having a generally cylindrical surface extending between a first end and a second end;

transferring the slug to the first forming station such that the first end faces the die section and the second end faces the punch section;

rotating the slug and transferring the slug to the second forming station such that the first end faces the punch section and the second end faces the die section;

at the second forming station, simultaneously extruding a first bore through the first end and forming a hemispherical surface at the second end;

at the third forming station, backward extruding a second bore at the first end;

at the fourth forming station, forming a counterbore in the second end; and at the fifth forming station, further forming the hemispherical surface to near final dimensions.

18. The method of claim 17, further comprising:

at the third forming station, further forming the hemispherical surface while simultaneously backward extruding the second bore; and at the fourth forming station, further forming the hemispherical surface to near final dimensions while simultaneously forming the counterbore.

19. The method of claim 17, further comprising:

transferring the slug to the third forming station such that the first end faces the punch section and the second end faces the die section;

rotating the slug and transferring the slug to the fourth forming station such that the first end faces the die section and the second end faces the punch section; and rotating the slug and transferring the slug to the fifth forming station such that the first end faces the punch section and the second end faces the die section.

* * * * *